US005535839A

United States Patent [19]

Brady

[11] Patent Number: 5,535,839

[45] Date of Patent: Jul. 16, 1996

[54] ROOF DRILL BIT WITH RADIAL DOMED PCD INSERTS

[76] Inventor: William J. Brady, 1767 Wishingwell Dr., Creve Coeur, Mo. 63141

[21] Appl. No.: 483,305

[22] Filed: Jun. 7, 1995

[51] Int. Cl.[6] ..... E21B 10/56; E21B 10/60

[52] U.S. Cl. ..... 175/427; 175/320; 175/434

[58] Field of Search ..... 175/426, 434, 175/432, 431, 414, 415, 417, 428, 427, 393, 320, 424, 421

[56] References Cited

U.S. PATENT DOCUMENTS

| | | | |
|---|---|---|---|
| 3,554,306 | 1/1971 | Wilburn | 175/417 X |
| 4,098,362 | 7/1978 | Bonnice | 175/329 |
| 4,303,136 | 12/1981 | Ball | 175/329 |
| 4,333,540 | 6/1982 | Daniels et al. | 175/329 |
| 4,549,615 | 10/1985 | Liang et al. | 175/417 X |
| 4,572,307 | 2/1986 | Tunell | 175/417 X |
| 4,602,691 | 7/1986 | Weaver | 175/329 |
| 4,811,801 | 3/1989 | Salesky et al. | 175/329 |
| 4,819,748 | 4/1989 | Truscott | 175/410 |
| 4,858,707 | 8/1989 | Jones et al. | 175/329 |
| 4,913,244 | 4/1990 | Trujillo | 175/65 |
| 4,932,484 | 6/1990 | Warren et al. | 175/329 |
| 5,099,929 | 3/1992 | Keith et al. | 175/61 |
| 5,099,935 | 3/1992 | Anthon et al. | 175/426 |
| 5,131,481 | 7/1992 | Smith | 175/428 |
| 5,335,738 | 8/1994 | Waldenstrom et al. | 175/434 X |
| 5,358,063 | 10/1994 | Hedlund et al. | 175/417 |
| 5,379,853 | 1/1995 | Lockwood et al. | 175/428 |
| 5,400,861 | 3/1995 | Sheirer | 175/427 |

*Primary Examiner*—Stephen J. Novosad
*Attorney, Agent, or Firm*—Richard G. Heywood

[57] ABSTRACT

A rotary drill bit having a head portion with at least two hard surfaced inserts having domed working surfaces and being oppositely oriented to face in the direction of rotation at positive rake angles, and a mounting adapter for removably securing the drill bit to a drilling machine.

31 Claims, 2 Drawing Sheets

ROOF DRILL BIT WITH RADIAL DOMED PCD INSERTS

BACKGROUND OF THE INVENTION

1. Field of the Invention

The invention relates generally to rotary drag bits, and more specifically to improvements in roof drill bits for drilling and boring as in roof bolting operations for tunnel construction and mining.

2. Description of the Prior Art

In the fields of industrial, mining and construction tools, polycrystalline diamond (PCD) is becoming more widely used in making cutting tool inserts, sometimes called polycrystalline diamond compacts (PDC). PCD materials are formed of fine diamond powder sintered by intercrystalline bonding under high temperature/high pressure diamond synthesis technology into a predetermined layer or shape; and such PCD layers are usually permanently bonded to a substrate of "precemented" tungsten carbide to form such PDC insert or compact. The term "high density ceramic" (HDC) is sometimes used to refer to a mining tool having an insert with a PCD layer. The term "chemical vapor deposition" (CVD) is a form of pure PCD used for inserts that are denser and last longer in use in the mining field. Other hard surfacing and layered materials, such as layered "nitride" compositions of titanium (TiN) and carbon ($C_2N_2$), are gaining acceptance in the mining field. All such "hard surface" materials—PCD, CVD and nitride compositions are applicable to the present invention and considered as alternatives unless specifically distinguished from each other herein.

Some of the basic underlying technology pertaining to PCD materials is disclosed in U.S. Pat. Nos. 4,525,178; 4,570,726; 4,604,106; and 4,694,918. In particular, U.S. Pat. No. 4,570,726 discloses special insert shapes for coring-type rotary drill bits, and suggests a tool having a curved working surface positioned at a slight negative rake angle from the axis of rotation (see also U.S. Pat. No. 4,858,707). The use of PCD materials in rotary earth drilling equipment replaces the long time use of tungsten carbide or the like as an abrasive cutting material; and most developmental work in PCD/CVD rotary drilling has been in the oil/gas field involving deep well boring into the earth's crust.

The principal types of drill bits used in rotary drilling operations are roller bits and drag bits. In roller bits, rolled cones are secured in sequences on the bit to form cutting teeth to crush and break up rock and earth material by compressive force as the bit is rotated at the bottom of the bore hole. In drag bits, PCD cutting elements on the bit act to cut or shear the earth material. The action of some flushing medium, such as fluid drilling mud or compressed air, is important in all types of drilling operations to cool the cutting elements and to flush or transport cuttings to the upper surface of the well. It is important to remove cuttings to prevent accumulations that will "ball up" or otherwise interfere with the crushing or cutting action of the bit and the cooling action is particularly important in the use of PCD/CVD cutters to prevent carbon transformation of the diamond material. In deep well drilling the circulation of drilling mud is contained in the well bore hole and can be recaptured and controlled at the well surface. U.S. Pat. No. 5,358,063 discloses a deep well drill bit having a series of hard material button inserts, and the invention pertains to improvements in transporting the flushing medium (compressed air) to prevent erosion around and loosening of the inserts.

Although roof drill bits are a form of rotary drag bit, it will be recognized that there are vast differences from deep well drilling. Roof bolting operations are overhead so the drilling operation is upward rather than downward, and in most cases the earth structure is formed of extremely hard rock or mineral (coal) deposits, although stratas of shale, loose rock and mud layers are frequently encountered in boring (drilling) operations for roof bolting construction. The use of large quantities of water (drilling mud) is typical in roof drilling to cool the cutting elements and flush the cuttings away, but overhead irrigation results in uncontrolled water loss and floor flooding that make working conditions unsafe and unpleasant. My prior U.S. Pat. Nos. 5,180,022; 5,303,787 and 5,383,526 disclose substantial improvements in HCD roof drill bits using PCD cutting elements constructed in a non-coring arrangement, and also teach novel drilling methods that greatly accelerate the speed of drilling action and substantially reduce bit breakage and change-over downtime. However, in earth structures that include shale, mud seams and other broken and soft formations, the HCD non-coring drill bit of my prior invention easily drills through but tends to plug and the cutting inserts may even shatter in working through stratas of extremely hard, broken and muddy earth conditions.

In a typical roof bolting operation, a series of 4 foot to 6 foot holes having a diameter of ¾ inch to 2 inches (or more) are drilled in the tunnel roof to receive bolts for anchoring roof support structures. In the past using tungsten carbide bits, frequently only a single 4 foot hole might be drilled before the bit became dull or broken. My prior invention of non-coring PCD insert drill bits (as disclosed in my prior '022 and '787 patents) was capable of drilling over 100–300 holes of 4 foot depth with a single bit and in shorter times with less thrust than the standard carbide bits in hard rock formations of 22,000–28,000 psi. However, as noted, it has been discovered that this prior non-coring drill bit tends to plug in drilling through mud seams and other soft or broken earth formations. It should be noted also that where long flexible cable roof bolts are used as for some soft earth formations, 12 foot to 24 foot holes are required and it may take up to 30 minutes to drill a single hole using prior art drill bits.

SUMMARY OF THE INVENTION

The present invention is embodied in a roof drill bit having a head portion with at least two PCD inserts having domed working surfaces and being oppositely oriented to face in the direction of rotation at positive rake angles, and wherein the outer margins of the inserts are disposed to define and form the bore diameter being formed by the tool.

It is an object of the present invention to provide an improved HCD rotary drill bit that will drill better in shale and medium hard earth formations as well as sandstone and muddy conditions; to provide an HCD rotary drill that will not plug easily when drilling in broken top and mud seams; that will prevent breakage of PCD inserts when drilling in fractured and broken top conditions; that creates a lower heat level to minimize heat transformation of the diamond cutters; and that offers a complementary drill tool to my prior HDC non-coring bit for improving mining operations in all types of earth formations. These and still other objects and advantages will become more apparent from the detailed description which follows.

BRIEF DESCRIPTION OF THE DRAWINGS

In the accompanying drawings which form a part of the specification, and wherein like numerals refer to like parts wherever they occur.

BRIEF DESCRIPTION OF THE PREFERRED EMBODIMENTS

This application is related by common subject matter to my co-filed application entitled Low Volume Air-Water Drilling Systems and Methods.

The present invention pertains to improvements in rotary mining tools of the roof drill bit type, and provides a mining alternative to my earlier non-coring roof drill bit as taught by my U.S. Pat. Nos. 5,180,022; 5,303,787 and 5,383,526—the disclosures of which are incorporated by reference herein as though fully set forth. As stated, my prior non-coring roof drill bit constitutes a major advance in providing a long wearing drill bit that in all respects out performs any prior carbide bit, and is especially successful in drilling through extremely hard rock formations. However, it has been found that the non-coring drill bit tends to plug in softer earth formations, and the present invention provides a coring-type rotary drill that performs extremely well in these soft and broken earth conditions.

Figure 3:
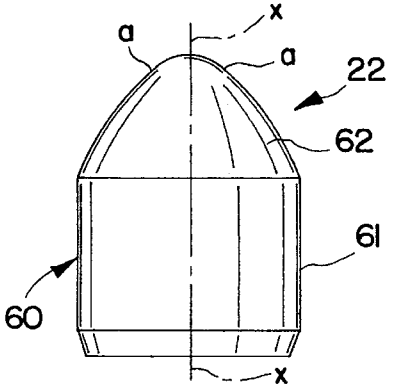
FIG. 3 is an enlarged side elevational view of a radially domed insert used in the roof drill bit invention.
Figure 2:
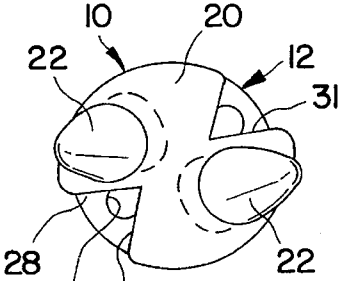
FIG. 2 is a top plan view of the drill bit and mounting adapter.
Figure 1:
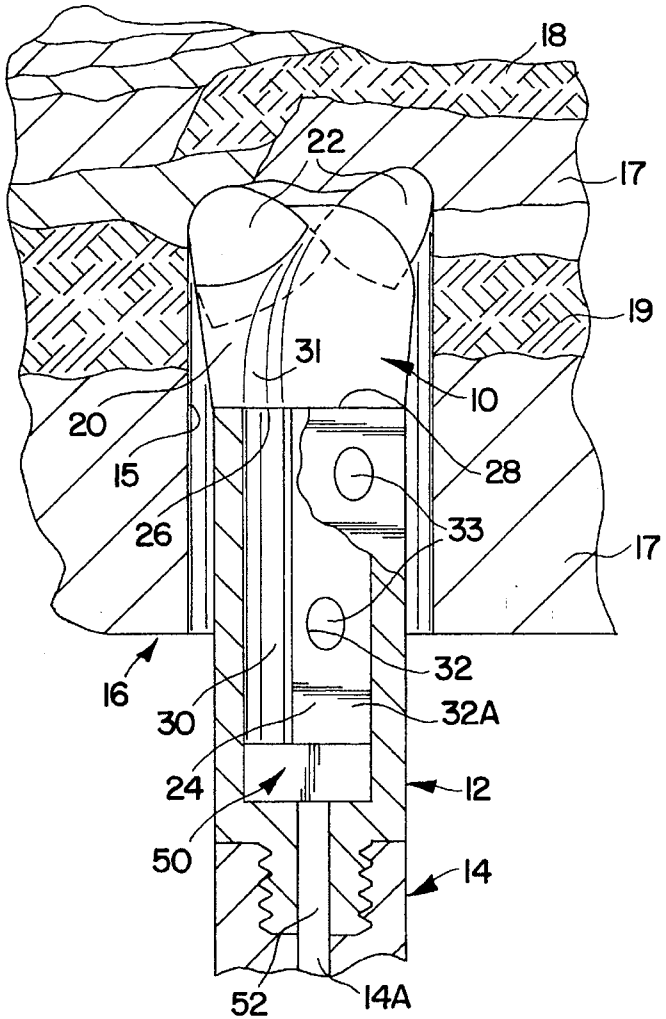
FIG. 1 is a side elevational view, partly broken away, of one embodiment of a roof drill bit and a mounting adapter as applied to a drill steel and shown during a boring application.

Referring to FIGS. 1–3, a preferred embodiment of the present invention is shown as a roof drill bit 10 connected through a mounting adapter 12 to a drill steel 14 and operating to drill a bore 15 in the roof 16 as in a mine or tunnel. The roof top formation is lined to illustrate solid rock 17, broken rock or shale 18 and mud seams 19. The drill bit 10 has a tempered steel body constructed and arranged to form a solid supporting head mass 20 for seating and supporting hard surfaced cutter inserts 22, and the bit body also includes a mounting shank 24 that is removably secured to the drive steel 14 comprising the rotational drive column of a drilling machine (not shown), such as a Fletcher double roof bolter which is well known throughout the mining industry. It will be understood that the drill bit 10 may be connected directly to the drive steel 14 according to any known practice, but that the mounting adapter 12 offers a novel alternative to the direct coupling methods already known. Thus, the body mass 20 has an annular shoulder 26 adapted to seat against the upper end of the machine drive steel 14 (if directly connected thereto) or against the upper surface 28 of the adapter 14 (as shown).

The shank portion 24 of the bit body is provided with the usual vertical water flutes 30, which are recessed inwardly on opposite sides of the shank and serve to channel the flushing fluids (i.e. drilling mud) used for cooling the cutter inserts 22 and cleaning away debris from the cutting area of the tool. The shank 24 has a pair of cross-bores 32 between opposed flat outer surfaces 32A of the shank to receive fastening pins or bolts 33 transversely of the fluted areas 30.

Figure 6:
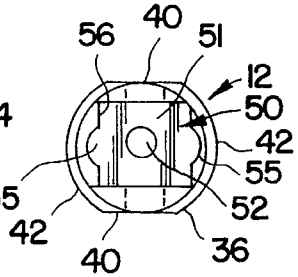
FIG. 6 is a top plan view of the adapter.
Figure 5:
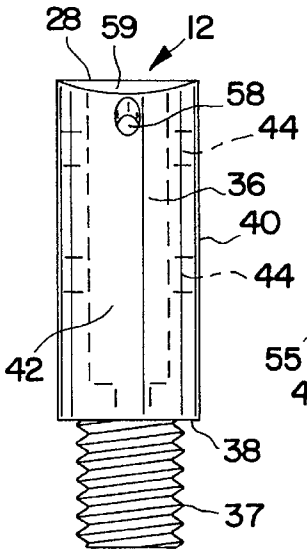
FIG. 5 is another side elevational view of the mounting adapter as rotated 90° from FIG. 4.
Figure 4:
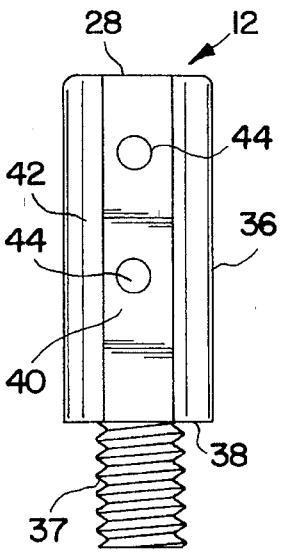
FIG. 4 is a side elevational view of the drill bit mounting adapter, as rotated 45° from the FIG. 1 position.

The mounting adapter 12 of the invention has an elongate body 36 with a threaded stub 37 on its lower end 38 for removable, but self-tightening, threaded connection to the upper end of the drive steel 14. The outer body wall of the adapter 12 has opposed flat surfaces 40 for wrench engagement and a pair of arcuate or partial cylindrical surfaces 42 substantially complementary to the drive steel outer wall. Aligned cross bores 44 are formed in opposite flat walls 40 to align with the cross bores 32 in the shank portion 24 of the drill bit 10 and receive the fastening pins 33 therethrough. One function of the mounting adapter 12 is to permit rapid assembly and disassembly for replacing the drill bit 10 on the drive steel 14 with a minimum of unproductive downtime. Another important function of the mounting adapter 12 is to accommodate the flow of flushing fluid from the hollow drive steel chamber 14A to the head mass 20 and cutter means 22. To that end the adapter 12 has a central body chamber 50 that connects through a port 52 in the threaded boss 37 to the drive steel chamber 14A. The central chamber 50 is constructed and arranged to receive the drill bit shank 24 with a sliding fit of the flat opposed shank walls 32A therein to prevent relative rotation. As stated, in this assembled relationship (FIG. 1), the head mass shoulder 26 seats on the upper end 28 of the adapter 12 and it should be noted that the lower end of the shank 24 is spaced above the floor 51 of central chamber 50 to define an open fluid receiving cavity for distribution to the opposed shank flutes 30. This distribution—and the vertical flow of flushing fluid upwardly through the adapter 12 is enhanced by providing vertical water flues or canals 55 in opposed walls 56 openly exposed to the shank water flutes 30 (see FIGS. 2 and 6). In addition, a pair of jet ports 58 are angularly formed between these water flues 55 and the outer arcuate adapter walls 42 adjacent to the upper end 28, which is beveled, at 59, to better accommodate the upward jetting of flushing fluid along the flumes 31 in the head mass 20 extending from the water flutes 30 and flues 55 to the cutter elements 22.

The essential feature of the invention resides in the construction and arrangement of the hard surfaced cutter inserts 22. As shown best in FIG. 3, a preferred cutter insert 22 of the invention has a main body 60 formed of tungsten carbide, with a cylindrical base portion 61 and an integral domed head 62 that is substantially bullet shaped in appearance. The domed head 62 is provided with a hard surfacing material that is "super-abrasive" or extremely hard and long wearing. Presently preferred are PCD/CVD materials, but nitride compositions of titanium, carbon and carbon boron are contemplated. The insert cap or covering layer 64 of PCD is pre-formed as a domed cup complementary to the domed head 42 of the steel body 60, and this cap or layer is bonded by applying a uniform compressive force (in the magnitude of one million pounds) on the PCD cap against the domed body section 62. The cylindrical side wall 61 is machined or finished to match the annulus of the domed insert layer or head 64.

It should be noted that the domed insert head 64 is shaped as a paraboloid and thus has an elongated conical-type body with a radially curved or rounded dome end, at "a—a", around the axis "x—x" of the insert 64, which may be referred to herein as a "radially domed insert" or a "paraboloid" insert. This type of insert is constructed and arranged to utilize the advantages of known conical drill bits in crushing and slicing earth formations by accommodating manufacturing techniques in bonding PCD materials, but it should be noted that these inserts 22 are in the range of 3/16 to ¾ inch diameter, and are applied to single headed rotary tools for cutting bores of 1 to 2 inches in diameter.

Referring particularly to FIGS. 1 and 2, the rotary drill bit 10 is constructed and arranged to use at least two of the radially domed PCD inserts 22. According to the invention, the head mass 20 of the drill bit 10 for each insert 22 is angularly drilled with a socket to receive and seat the insert base 61 so that the axis x—x of the insert is pitched forwardly and outwardly at preselected rake angles toward the direction of rotation. Stated another way, the axis x—x of each insert 22 is at a positive rake angle, such as 15°, slanting forwardly from vertical in the direction of rotation on the tool axis—and is at a negative skew angle, such as 10°, slanted outwardly from vertical and the arc of rotation on the tool axis. The range of the positive rake angles is about 5° to 30° with 15° being optimum, and the range of negative skew angles is about 1° to 15° with 10° being considered optimum. Thus, the peak of the domed insert 22 defined by the rounded radial arc "a—a" projects outwardly of the head mass side wall for crushing or drilling engagement to ream the bore 15 and cut clearance for the entire tool 10. As indicated and clearly shown, the paraboloid inserts 22 project in opposite directions in the direction of rotation, and the forces exerted therein during drilling are transmitted back through the insert body to the head mass 20 of the tool.

It should be recognized that the invention is most applicable to smaller sized roof drill bits boring holes of under 2 inches due to the higher thrust required to drill at the same rate as my patented non-coring HDC drill bits, which means that higher torque is experienced and problems with shank shear are more like to occur in larger tools.

Experimental field testing was conducted with two prototype roof drill bits 10 of the FIG. 1 embodiment, which testing established that the invention is meritorious. The first testing was conducted on a Fletcher double boom roof bolter machine in ground that was considered very hard as well as badly fractured, and included mud layers up to 12 inches thick. Six holes were drilled using both sides of the machine, and the penetration rate was about 6 foot/minute, and was considered excellent. No plugging of flushing water flutes occurred, and the radially domed PCD inserts (22) showed no wear or gauge loss. Second testing of the tool 10 was in a highly fractured mine area where 16 foot roof bolts were needed. Conventional tungsten carbide bits were generally used there because of breakage since the ground was very hard, and it would take 6–8 carbide bits to drill 10 feet or less. Each prototype tool of the invention easily drilled an additional 36 feet in this same area. With reference to the terms "hard" and "soft", hard rock generally means a compressive strength of 20,000–35,000 psi; and soft earth formations, such as shale, means a compressive strength of up to about 15,000 psi. "Medium" means compressive strength in the intermediate range of about 15,000–20,000 psi. Thus, it is clear that the coring-type drill bit 10 of the present invention provides a rugged and efficient drilling tool for operations especially in softer and fractured earth formations.

Figure 7:
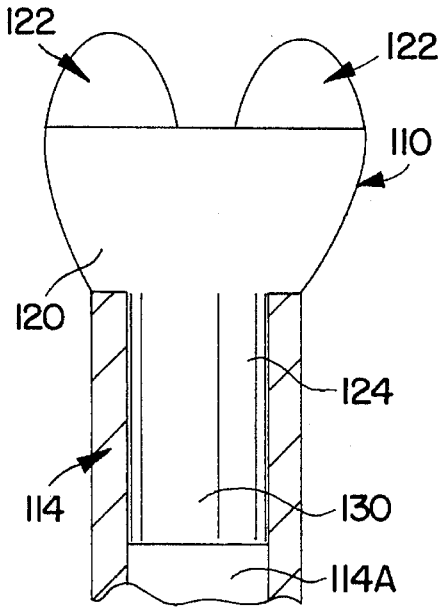
FIG. 7 is a side elevational view diagrammatically showing a second embodiment of the FIG. 1 roof drill bit.
Figure 10:
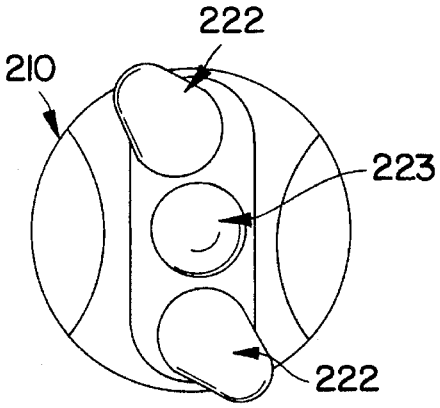
FIG. 10 is a plan view of the FIG. 9 embodiment.
Figure 11:
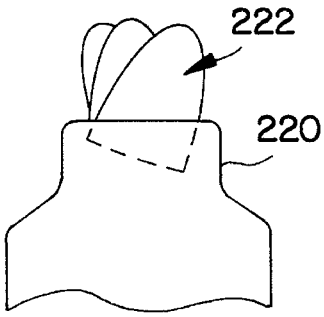
FIG. 11 is a side elevational view of the third embodiment, as rotated 90° from FIG. 9.
Figure 8:
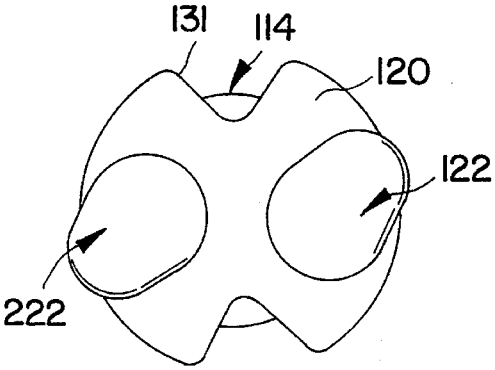
FIG. 8 is a plan view of the FIG. 7 embodiment.
Figure 12:
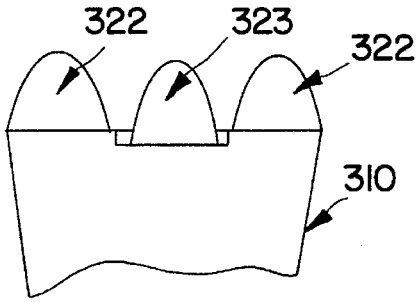
FIG. 12 is a diagrammatic view of another embodiment of the invention.
Figure 9:
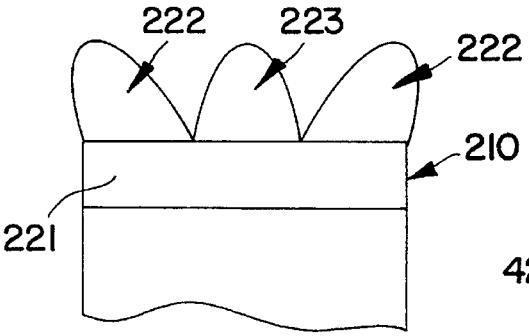
FIG. 9 is a side elevational view diagrammatically showing a third embodiment of the invention.
Figure 13:
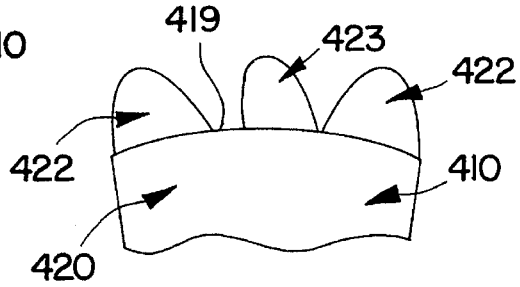
FIG. 13 is a diagrammatic view of still another embodiment of the invention.

Referring to FIGS. 7–13, other arrangements of coring-type roof drill bits having paraboloid-type PCD inserts are illustrated for example. FIGS. 7–8 show a drill bit 110, similar to FIG. 1, in which the shank 124 is pinned directly to the drive steel 114 and the flushing fluid flows through the flutes 130 and head mass channels 131 in a typical way to cool and clean the working surface areas of the paraboloid inserts 122. FIGS. 9–11 illustrate a three insert embodiment of tool 210 in which the head mass 220 includes an upper raised connector block 221 extending across the diameter of the tool and mounts the three inserts with the bases in alignment. The outer inserts 122 are set at positive rake and negative skew angles as previously set out, and the central insert 223 is set at 0° skew so that its axis ("x—x") is vertical. The central insert 223 is offset from the rotational axis of the tool, and it serves effectively as a core breaker. FIG. 12 shows a drop-center drill bit 310 having three inserts, in which the central insert 323 has its apex below the outer cutter inserts 322 that carry the primary load of cutting the bore again, the asymmetrical central insert 323 is a core cutter. FIG. 13 shows another three insert tool 410 having a body head mass 420 with a rounded or curved upper surface 419 and the inserts 422, 423 may be mounted therein in asymmetrical or symmetrical arrangements as taught herein.

It is now apparent that the objects and advantages of the present invention have been met. The domed insert tools of the present invention are substantially non-plugging and the jet ports 58 of the adapter 12 along with the channels 55 effectively deliver flushing fluid for cooling and cleaning.

Changes and modifications of the disclosed forms of the invention will become apparent to those skilled in the mining tool art, and the invention is only limited by the scope of the appended claims.

What is claimed is:

1. A rotary tool having a bit body with a shank portion constructed and arranged for attachment to a drill column for rotation on a central axis, and with a head portion constructed and arranged for drilling and boring as in roof bolting operations in tunnel construction and mining;

at least two inserts each having a domed working surface formed from a super-abrasive material;

said two inserts being rigidly mounted on said head portion and oppositely oriented with both of said domed working surfaces facing in the direction of rotation and being angularly disposed with the axis of each insert extending at a positive rake angle relative to an axially extending plane normal to the direction of rotation; and the domed surfaces having curved end caps disposed to define a predetermined bore diameter to be formed by the tool.

2. A rotary tool according to claim 1 in which said positive rake angle of the inserts is in the range of 5° to 30°.

3. A rotary tool according to claim 1 wherein the optimum positive rake angle of the inserts is about 15°.

4. A rotary tool according to claim 1 wherein the inserts are positioned at a negative skew angle relative to the arc of rotation.

5. A rotary tool according to claim 4 wherein the negative skew angle of the inserts is in the range of 1° to 15°.

6. A rotary tool according to claim 4 wherein the optimum negative skew angle of the inserts is about 10°.

7. A rotary tool according to claim 1 wherein the inserts are positioned at positive rake angles in the range of 5° to 30° and also at negative skew angles in the range of 1° to 15°.

8. A rotary tool according to claim 1 further comprising a drill bit adapter constructed and arranged for removably attaching the bit body to a drill column, the drill bit adapter comprising a first end for attachment to the drill column and a second end defining socket means for non-rotatably receiving the shank portion of the drill bit, and other means constructed and arranged for channeling flushing fluids through the adapter to the inserts.

9. A rotary tool according to claim 8, in which said other means includes jet port means extending angularly from said channeling means outwardly of the adapter intermediate its ends.

10. A rotary tool having a bit body with a shank portion constructed and arranged for attachment to a drill column for rotation on a central axis, and with a head portion constructed and arranged for drilling and boring as in roof bolting operations in tunnel construction and mining;

at least two inserts each having a mounting base and a domed working surface formed on one end around a center axis, the working surfaces being formed from a super-abrasive material;

said two inserts being constructed and arranged with the mounting bases rigidly mounted on said head portion, and being oppositely oriented with the axis of each said domed working surface extending angularly in the direction of rotation relative to the central axis of said bit body; and the outer rounded peak areas of said domed working surfaces being disposed to define a predetermined bore diameter to be formed by the tool.

11. A rotary tool according to claim 10 wherein the axial angle of the domed working surface is a positive rake angle in the range of 5° to 30°.

12. A rotary tool according to claim 10 wherein the axial angle of the domed working surface is a positive rake angle of about 15°.

13. A rotary tool according to claim 10 wherein the axial angle of the domed working surface is a negative skew angle in the range of 1° to 15°.

14. A rotary tool according to claim 10 wherein the axial angle of the domed working surface is a negative skew angle of about 10°.

15. A rotary tool according to claim 10, wherein the domed inserts are positioned at positive rake angles in the range of 5° to 30° and also at negative skew angles in the range of 1° to 15°.

16. A rotary tool according to claim 10 further comprising a drill bit adapter constructed and arranged for removably attaching the bit body to a drill column, the drill bit adapter comprising a first end for attachment to the column and a second end defining socket means for receiving the shank portion of the drill bit, and other means constructed and arranged for channeling flushing fluids from the drill column through the adapter to the inserts.

17. A rotary tool according to claim 16, in which said other means includes jet port means extending angularly from said channeling means outwardly of the adapter intermediate its ends.

18. A rotary tool according to claim 10, in which the domed working surface of each insert is a paraboloid.

19. A rotary tool having a bit body with a shank portion constructed and arranged for attachment to a drill column for rotation on a central axis, and with a head portion constructed and arranged for drilling and boring as in roof bolting operations in tunnel construction and mining;

at least two inserts each having a domed working surface with a rounded peak end and being formed from a super-abrasive material;

said two inserts being rigidly mounted on said head portion and oppositely oriented with both of said domed working surfaces facing in the direction of rotation and being angularly disposed with the axis of each insert extending at a negative skew angle relative to an axial plane normal to the direction of rotation; and the outer peak ends of said working surfaces being disposed to define a predetermined bore diameter to be formed by the tool.

20. A rotary tool according to claim 19 wherein the negative skew angle of the inserts is in the range of 1° to 15°.

21. A rotary tool according to claim 19 wherein the negative skew angle of the inserts is about 10°.

22. A rotary tool according to claim 19 wherein the inserts are positioned at a positive rake angle in the range of 5° to 30° relative to a plane extending across the diameter of the tool and normal to the direction of rotation.

23. A rotary tool according to claim 19 wherein said positive rake angle of the inserts is about 15°.

24. A drill bit adapter for removably connecting a drill column and the shank portion of a roof drill bit having a bit body constructed and arranged for rotation on a central axis as for drilling and boring in roof bolting operations, the drill bit including at least two inserts each having a mounting base and a paraboloid PCD working surface formed around a center axis and being constructed and arranged for opposite orientation with the axis of each said paraboloid working surface extending angularly in the direction of rotation relative to the central axis of said bit body, and the outer rounded peak areas of said paraboloid working surfaces being disposed to define a predetermined bore diameter to be formed by the tool, the drill bit adapter comprising a first end for attachment to the drill column and a second end defining socket means constructed and arranged for removably receiving the shank portion of the drill bit, and other means constructed and arranged for channeling flushing fluids through the adapter from the drill column to the inserts.

25. A rotary tool according to claim 10, including three domed inserts mounted on the head portion, the third insert being constructed and arranged to form a core cutter intermediate of the two first mentioned inserts.

26. A rotary tool according to claim 25, in which the head portion has a drop center, and the third insert is secured thereto and having its rounded peak positioned below the peaks of the outer two inserts.

27. A rotary tool according to claim 25, in which the head portion has a curved upper surface, and the three domed inserts are radially oriented thereto.

28. A rotary tool according to claim 25, in which the three domed inserts are substantially diametrally aligned across the head portion, and the center insert is positioned off center and closer to one of the outer inserts than the other.

29. The rotary tool according to claim 1, in which said super-abrasive material is selected from a class of materials comprising polycrystalline diamond and chemical vapor deposition compositions, and nitride compositions of titanium, carbon and carbon boride.

30. The rotary tool according to claim 10, in which said super-abrasive material is selected from a class of materials comprising polycrystalline diamond and chemical vapor deposition compositions, and nitride compositions of titanium, carbon and carbon boride.

31. The rotary tool according to claim 19, in which said super-abrasive material is selected from a class of materials comprising polycrystalline diamond and chemical vapor deposition compositions, and nitride compositions of titanium, carbon and carbon boride.

* * * * *